US006003723A

United States Patent [19]

Morand

[11] Patent Number: 6,003,723

[45] Date of Patent: Dec. 21, 1999

[54] LARGE CAPACITY TOWEL DISPENSER

[75] Inventor: Michel Morand, Montreal, Canada

[73] Assignee: Perrin Manufacturing, City of Industry, Calif.

[21] Appl. No.: 08/921,900

[22] Filed: Sep. 2, 1997

[51] Int. Cl.[6] ..... A47K 10/24

[52] U.S. Cl. ..... 221/44; 221/45; 221/53; 221/54; 221/55

[58] Field of Search ..... 221/44, 45, 53, 221/54, 55, 63

[56] References Cited

U.S. PATENT DOCUMENTS

| | | | |
|---|---|---|---|
| 1,060,725 | 5/1913 | Wheeler | 221/48 |
| 1,319,281 | 10/1919 | Hoberg | 221/54 |
| 1,632,446 | 6/1927 | Krueger | 221/53 |
| 1,898,983 | 4/1933 | Wheeler, Jr. | 221/48 |
| 1,914,666 | 6/1933 | Hope et al. | 221/53 |
| 2,143,614 | 1/1939 | Winter et al. | 221/53 |
| 2,171,415 | 8/1939 | Haney | 221/55 |
| 2,195,437 | 4/1940 | West | 221/48 |
| 2,216,323 | 10/1940 | Ringler | 221/48 |
| 3,935,965 | 2/1976 | Stevens | 221/45 |
| 4,678,099 | 7/1987 | Matsui | 221/48 |
| 4,768,679 | 9/1988 | Matsui | 221/48 |
| 4,877,154 | 10/1989 | Matsui | 221/48 |
| 5,158,205 | 10/1992 | Bodziak et al. | 221/51 |
| 5,219,092 | 6/1993 | Morand | 221/53 |
| 5,322,186 | 6/1994 | Frazier et al. | 221/44 |

FOREIGN PATENT DOCUMENTS

| | | | |
|---|---|---|---|
| 555577A1 | 8/1993 | European Pat. Off. | 221/53 |
| 2195987 | 4/1988 | United Kingdom | 221/44 |

*Primary Examiner*—William E. Terrell
*Assistant Examiner*—Wonki K. Park
*Attorney, Agent, or Firm*—Sheldon & Mak

[57] ABSTRACT

A dispenser apparatus for stacked single-fold towel sheets has a rear wall, side walls, and front and rear funnel walls extending to a funnel height between bottom portions of the side walls on opposite sides of a feed slot; and a pair of shelf members projecting downwardly and inwardly from respective ones of the side walls, each shelf member having a shelf width perpendicular to the rear wall being approximately 45 percent of a housing depth between upper extremities of the funnel walls, inward extremities of the shelf members, the inward extremities being spaced above the feed slot within the funnel height and being spaced apart by a distance of not greater than approximately 90 percent of the stack width for partially supporting the sheets. Each shelf member has an upwardly and inwardly facing panel surface that forms a side angle of approximately 45 degrees with the side wall. A perimeter contour of each shelf member has a plan radius of approximately 0.5 inch at the inward extremity, diverging to the shelf width from the plan radius at a taper angle of approximately 90 degrees, the perimeter contour also having an edge profile of smooth curvature including a shelf lip radius of approximately 0.15 inch extending outwardly and downwardly from the panel surface. Another aspect of the invention provides a method for cleaning a facility having the dispenser.

17 Claims, 5 Drawing Sheets

LARGE CAPACITY TOWEL DISPENSER

BACKGROUND

The present invention relates to dispensers for folded and stacked sheets such as paper towels and the like, and more particularly to dispensers for sheets having "single-fold" configuration.

Paper towel dispensers of the type wherein folded sheets are taken from the bottom of a stack by pulling from a bottom dispenser opening are well known, being used in many commercial and institutional settings. In the single-fold configuration, successive sheets feed alternately from front and rear bottom extremities of the stack, and typical dispensers of the prior art have a lateral feed slot that is centrally spaced between front and rear housing walls. The dispensers of the prior art are not entirely satisfactory, for a number of reasons. For example:

1. The sheets are subject to tearing because of excessive frictional resistance to feeding, particularly when the dispenser is loaded with a large quantity of sheets;

2. Consequently, many dispensers are configured for receiving only short stacks of sheets, having insufficient capacity for feeding over a full maintenance cycle without becoming empty; and 3. The tearing problem is exacerbated by the use of towel materials having enhanced softness and absorption, particularly when accessed by users having wet fingers.

Another problem is that many dispenser installations are subject to cleaning by pressure water streams from hoses. In such situations, towel sheet dispensers must be emptied, dried out, and reloaded. Although dispenser housings can be configured for shedding water, some water gets in through the feed slot, soaking a bottom portion of the stack of sheets to the point of preventing further feeding until the dispenser id dried and reloaded.

Thus there is a need for a high capacity dispenser that can reliably feed sheets even when accessed by wet fingers. There is a further need for a dispenser that is water resistant to the point of not requiring reloading after being hosed off.

SUMMARY

The present invention meets these needs by providing a dispenser having internal side protrusions for promoting limited loading along a bottom feed slot over a wide range of stack heights. In one aspect of the invention, the dispenser includes a housing having a rear wall, side walls, and a funnel portion including front and rear funnel walls extending between bottom portions of the side walls, the funnel walls being spaced apart, forming a feed slot; and a pair of shelf members projecting downwardly and inwardly from respective ones of the side walls, each shelf member having a shelf width perpendicular to the rear wall being less than the stack depth, inward extremities of the shelf members being spaced apart by a distance of not greater than approximately 90 percent of the stack width for partially supporting the sheets.

Each shelf member can have an upwardly and inwardly facing panel surface and a perimeter contour that tapers from the shelf width toward the inward extremity. Each shelf member can have an edge profile along the perimeter contour, the edge profile having a smooth curvature extending outwardly and downwardly from the panel surface. The edge profile can include a shelf lip radius that is not less than approximately 0.1 inch. The perimeter contour of each shelf member can have a plan radius at the inward extremity that is not less than approximately 0.3 inch. The perimeter contour can diverge from the plan radius at a taper angle of approximately 90 degrees.

The shelf width is preferably not more than approximately half of the stack depth for promoting complex curvature of sheets supported thereon. The funnel portion can have a housing depth extending forwardly of the rear wall, the shelf width being approximately 45 percent of the housing depth.

The panel surface of each shelf member can form a side angle of approximately 45 degrees with the side wall. The funnel portion can have a funnel height, the inner extremities of the shelf portions being spaced above the feed slot within the funnel height. The shelf members can be adjustably connected to the respective side walls. Preferably the inner extremities of the shelf members are located laterally within the feed slot not more than halfway toward the rear funnel wall for avoiding inducement of forward leaning of the stack. Preferably the dispenser further includes a shelf spacer selectively connected between one side wall and an associated shelf member for adjusting the shelf spacing.

The apparatus can further include a pair of shelf modules, each shelf module including one of the shelf members and a registration member, each side wall of the housing further including respective engagement members for locatably receiving the registration members. Each engagement member can be formed as a recess in a corresponding side wall of the housing, each registration member forming a flush insert in the side wall. The side walls can include substantially flush upper and lower side wall portions, the recesses being formed in upper extremities of the lower side wall portions, the registration members having vertical dovetail engagement with the recesses, upwardly extending edges of the upper side wall portions being located for allowing passage of the registration members downwardly into the recesses. The side walls can be formed as separable upper and lower side wall portions, the housing having a rear member including the upper side wall portions and a funnel member including the lower side wall portions and the funnel portion, the funnel member being insertable in the rear member and having a fastener opening for receiving a wall-mounting fastener whereby the rear member is fixedly located relative to the funnel member when the funnel member is inserted in the rear member and clamped to a wall by the wall-mounting fastener, the recesses being formed in the lower side wall portions, the registration members having vertical dovetail engagement with the recesses.

Another aspect of the invention provides a method for cleaning a facility having the dispenser installed therein, a stack of folded towel sheets being loaded in the housing with one sheet extending through the feed slot, the method comprising the steps of:

(a) partially supporting the stack within the funnel portion on a pair of shelf members;

(b) projecting a bottom sheet of the stack through the slot;

(c) washing the dispenser using a stream of liquid while the sheet remains extending through the feed slot and without unloading the dispenser;

(d) drying outside surfaces of the dispenser; and (e) withdrawing the sheet from the feed slot, thereby drying inside surfaces of the dispenser adjacent the feed slot and advancing another sheet into the feed slot.

The feed slot can have a rearwardly extending enlargement for facilitating the projecting step, the projecting step including obtaining resting engagement of the bottom sheet on the funnel portion forwardly of the feed slot by, if necessary, withdrawing a sheet from the feed slot, a next sheet being substituted as the bottom sheet.

DRAWINGS

These and other features, aspects, and advantages of the present invention will become better understood with reference to the following description, appended claims, and accompanying drawings, where:

DESCRIPTION

Figure 1:
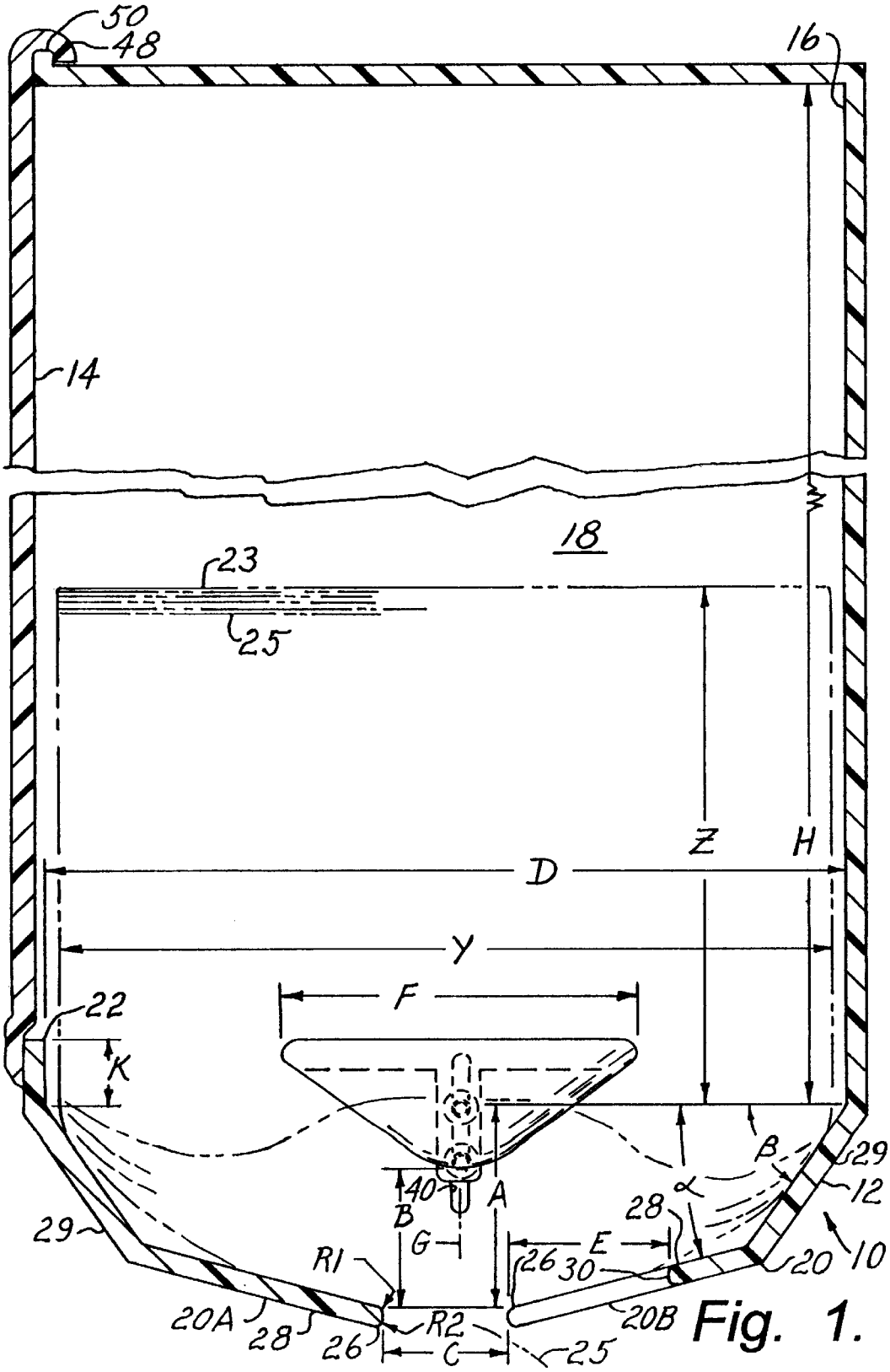
FIG. 1 is a lateral sectional elevational view of a sheet dispenser according to the present invention.

The present invention is directed to a high capacity towel sheet dispenser that is particularly reliable and easy to maintain. With reference to FIGS. 1–5 of the drawings, a sheet dispenser 10 includes a housing 12 and a service door 14, the housing having a rear wall 16, opposite side walls 18, and a funnel portion 20 including respective front and rear sloping funnel walls 20A and 20B, the side walls 18 extending to the bottom of the funnel portion 20. The rear wall 16 has a main height H above the funnel wall 20B and a width W between the side walls 18, the funnel portion 20 having a funnel height A below the main height H, the side walls having a housing depth D between upper extremities of the funnel walls 20A and 20B, a front wall portion 22 extending to a front height K above the front funnel wall 20A, the dimensions being internal of the housing 12. The service door 14 extends vertically above the front wall portion 22, being generally coplanar therewith, for facilitating loading of a stack 23 of folded towel sheets 25 into the housing 12 as indicated by dashed lines in FIGS. 1 and 3. The stack 23 has a width X, a depth Y, and a height Z. The width X is typically between 9.25 inches and 9.75 inches, the depth Y corresponding to a folded width of the sheets 25. The sheets 25 can be conventional single-fold towels, which typically come in packs of 250 having a height of approximately 2.9 inches from Fort Howard Corporation of Green Bay, Wis. These towels have a folded width of approximately 5.38 inches, corresponding to the depth Y of the stack, the stack height Z being approximately 11.5 inches per 1000 sheets.

Figure 2:
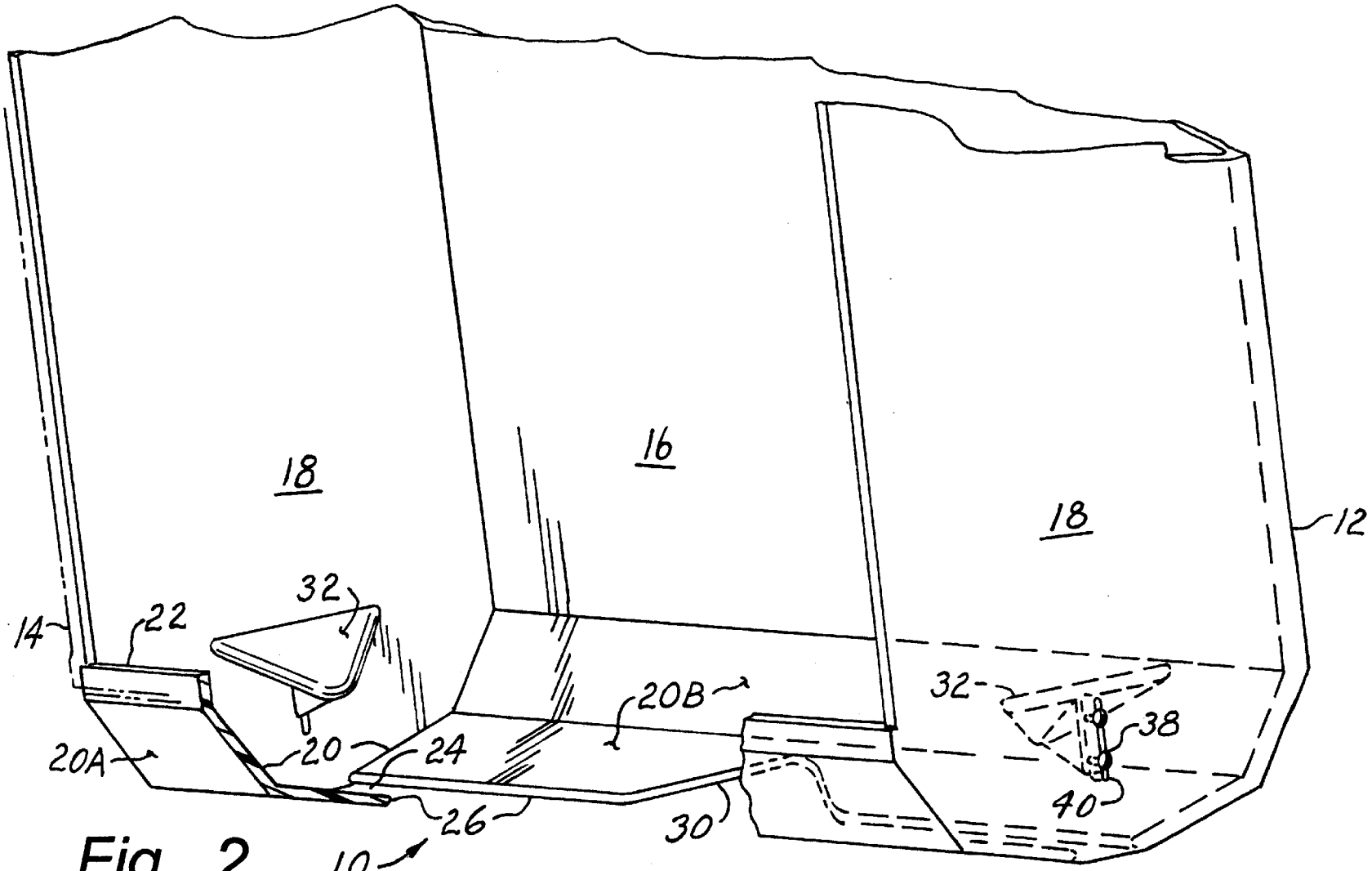
FIG. 2 is a fragmentary oblique perspective view of the dispenser of FIG. 1.

As shown in FIG. 2, a feed slot 24 extends between the side walls 18 between the funnel walls 20A and 20B, each of the funnel walls 20A and 20B having a smoothly contoured lip extremity 26, the lip extremities 26 being spaced apart by a slot width C for permitting sequential feeding of the sheets 25 from the funnel portion 20. Each of the funnel walls 20A and 20B has a floor portion 28 that slopes upwardly at a floor angle $\alpha$ away from the lip extremity 26, and a ramp portion 29 that slopes upwardly more steeply at a ramp angle $\beta$ between the floor portion 28 and the respective rear or front wall 16 or 22 for urging the sheets 25 toward the lip extremities 26. Also, the rear funnel wall 20B has a centrally located notch 30 formed therein, the lip extremities 26 being locally spaced an additional notch depth E farther apart for facilitating initial grasping and withdrawal of a first sheet 25 from the dispenser 10. It will be understood that the notch 30 may also be used to facilitate resumption of feeding in case the dispenser is serviced by the addition of sheets 25 that are not coupled by interleaving with sheets previously remaining. The lip extremities 26 are each formed with an upper lip radius R1 and a lower lip radius R2 for smooth passage of the sheets 25.

Figure 5:
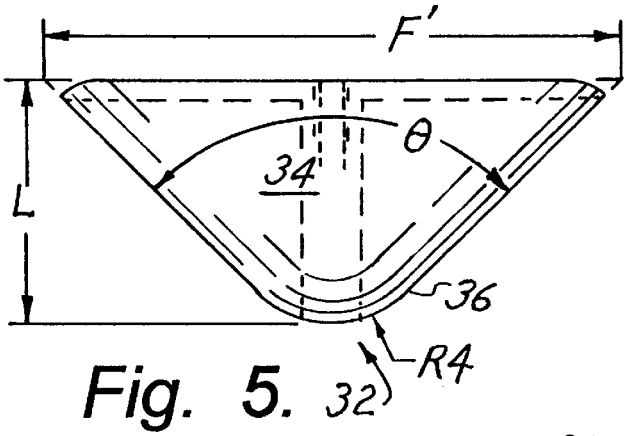
FIG. 5 is a face view of the shelf element of FIG. 4 on line 5—5 therein.
Figure 3:
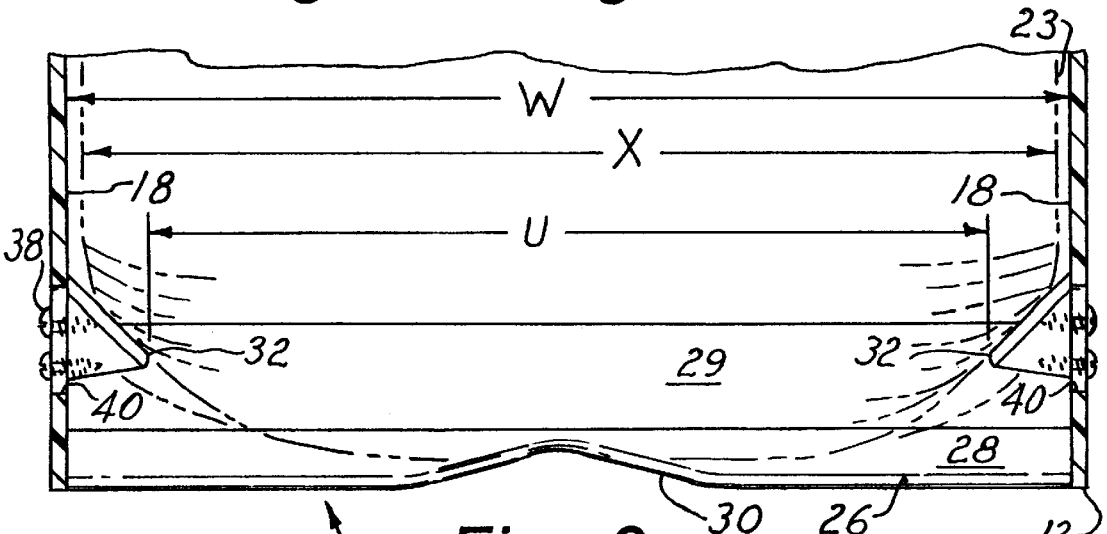
FIG. 3 is a front sectional elevational view of the dispenser of FIG. 1.

According to the present invention, a pair of sloping shelf members 32 are mounted on inside surfaces of the side walls 18, approximately centered between the back and front walls 16 and 22 for partially supporting the stack 23. More particularly, the shelf members 32 are spaced laterally apart by a distance U, at a distance B above the lip extremities 26 of the funnel portion 20, the distance U being not greater than approximately 90 percent of the stack width X. In an exemplary and preferred configuration as shown in the drawings, each shelf member 32 has a panel portion 34 that tapers downwardly and inwardly from the respective side wall 18 at a shelf angle $\phi$ therewith, the panel portion 34 having a thickness T, being formed with a shelf lip radius R3 along an edge contour 36 that extends to proximate the side wall 18 for smoothly slidingly supporting passing sheets 25 of the stack 23. Each shelf member 32 has a width F at the side wall 18 as shown in FIG. 1, the panel portion 34 having a length L between the wall 18 and an inward or free extremity thereof as shown in FIG. 5. The edge contour 36 has a pattern radius R4 at the free extremity and having diverging segments that project at an included taper angle $\theta$ to a counterpart F' of the shelf width F as further shown in FIG. 5. Thus the stack 23 is partially supported on the shelf members 32 for limiting frictional resistance by the front and rear funnel portions 20A and 20B, the degree of support by the shelf members 32 being roughly proportional to the total weight of the stack 23 that remains above the shelf members. As further shown in the drawings, the sheets 25 of the stack 23 become substantially separated below the shelf members 32.

As further shown in the drawings, each shelf member 32 is anchored by a pair of fasteners 38 that extend through a fastener slot 40 that is formed in the corresponding side wall 18, the fasteners 38 engaging a triangular rib portion 42 of the shelf member 32 that is centrally located under the panel portion 34. The slots 40 are spaced horizontally between the lip extremities 26 of the funnel portion 20 by a distance G from the rear funnel wall 20B, the distance G being nominally half of the slot spacing C.

An experimental prototype of the dispenser 10 as described above has been built and tested, with favorable results. As built, the width W was approximately 9.75 inches, the housing depth D was approximately 5.80 inches, and the height H was approximately 16 inches. The distance A was approximately 1.5 inches, the slot spacing C was approximately 0.9 inch, the floor and funnel angles $\alpha$ and $\beta$ being approximately 15 and 55 degrees, respectively. The shelf members 32 were made with the width F' approximately 2.85 inches ($F \cong 2.66$), the length L approximately 1.19 inches, and the radii R3 and R4 being respectively approximately 0.16 and 0.50 inch, the taper and side angles $\theta$ and $\phi$ being approximately 90 and 45 degrees, respectively. The slots 40 were located for permitting vertical adjustment of the distance B between approximately 0.75 inch and approximately 1.37 inch, the distance G being approximately 0.45 inch. Additional counterparts of the slots 40 were also located with the distance G being approximately 0.25 and 0.63 inch. In tests performed with the width X and depth Y of the stack 23 being 9.59 and 5.41 inches, respectively, the dispenser 10 holding sheets 25 with the stack height Z being approximately 16 inches (approximately 5.5 packs of 250 sheets, a total of approximately 1375). Reliable feeding was obtained from the full capacity until exhaustion of the stack 23, the distance B being adjusted to approximately 1.0 inch, and with the distance G being 0.28 to 0.63 inches. As a result of carefully observing the action of the shelf members 32 in supporting the stack 23, it was determined that optimal placement of the slots 40 is between the 0.45 inch and 0.63 inch locations. The best results were obtained with the shelf members 32 centered relative to the slot width C, or slightly offset forwardly up to approximately 0.06 inch toward the front funnel wall 20A from being centered within the slot width C. Thus the distance G is preferably not less than half of the slot spacing C for preventing the stack 23 from being biased toward or against the door 14 by the shelf members 32. Conversely, the distance G can be made intentionally slightly greater than half of the distance C for biasing the stack 23 away from the door 14.

The vertical adjustability provided by the slots 40 advantageously accommodates a greater variation in the folded size of the sheets 25 than would otherwise exhibit reliable feeding. For example, if the stack depth Y is reduced, the distance B can be reduced to maintain a desired balance between the support provided by the funnel portion 20 and the shelf members 32. A suitable range of this adjustment is plus or minus approximately 0.125 inch. Similarly, if the stack width X is reduced, the distance B is preferably increased for augmenting the proportion of support provided by the shelf members 32. In other words, slightly raising or lowering the shelf members 32 adjusts for a desired loading of the sheets 25 on the floor portion 28 of the funnel portion 20.

Figure 6:
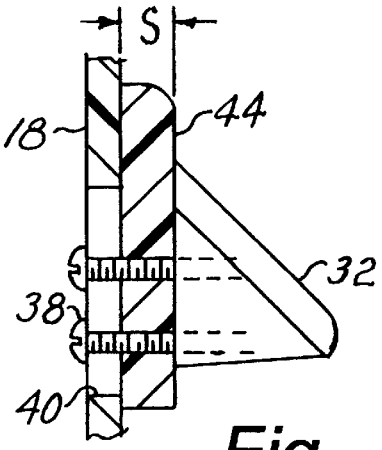
FIG. 6 is a fragmentary sectional view showing the shelf of FIG. 4, in an alternative configuration of the dispenser of FIG. 1.
Figure 4:
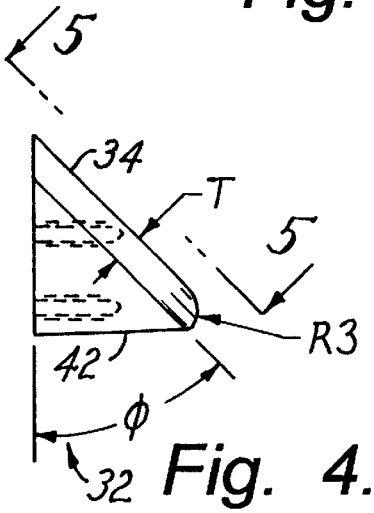
FIG. 4 is a front elevational detail view of a sloping shelf element of the dispenser of FIG. 1.

With further reference to FIG. 6, gross variations in the stack width X relative to the width W can be accommodated by adjustment of the shelf spacing U, such as by selectively interposing a spacer 44 between each shelf member 32 and the associated side wall 18, the spacer 44 having a thickness S that is approximately half of the difference between the stack width Y and the corresponding width Y for which there is optimal feeding of the sheets 25. Conversely, the effect of the vertical adjustment described above can be simulated by slight variations of the shelf spacing U.

The dispenser 10, in addition to providing improved feeding of towel sheets from large stacks thereof, also facilitates maintenance of installations being cleaned by streams of water. This is because the shelf members 32 produce separation of the sheets 25 above the feed slot 24 as described above, in that water that gets on the lip extremities 26 of the funnel portion 20 has only limited wicking into the stack 23. This is particularly true if care is taken to insure that the sheet 25 extends out of the funnel portion 20 from contact with the front funnel wall 20A for blocking entry of water between layers of the stack 23 above the rear funnel wall 20B. The access door 14 is preferably connected to the housing 12 in a manner that excludes water, such as by having a curved perimeter extremity 48 that engages the housing 12 as shown in FIG. 1. The housing 12 can have an outwardly projecting flange portion 50 that extends into the perimeter extremity 48, a bottom portion of the door being closed in overlapping relation to the front wall 22 of the housing 12, the door 14 being latched in its closed position in any suitable manner, thereby excluding water from entering the dispenser 10 except by way of the feed slot 24. Accordingly, the present invention provides a method for cleaning a facility having the sheet dispenser 10 installed therein, a stack of folded towel sheets being loaded in the housing with one sheet extending through the feed slot, the method comprising the steps of: partially supporting the stack within the funnel portion on a pair of shelf members; projecting a bottom sheet 25 between the front and rear funnel walls 20A and 20B, preferably feeding another sheet 25 if necessary to insure that the bottom sheet extends from the front wall 20A out of the dispenser 10; washing the dispenser using a stream of liquid while the sheet remains extending through the feed slot and without unloading the dispenser; drying outside surfaces of the dispenser; and withdrawing the sheet from the feed slot, thereby drying inside surfaces of the dispenser adjacent the feed slot and advancing another sheet into the feed slot.

Figure 7:
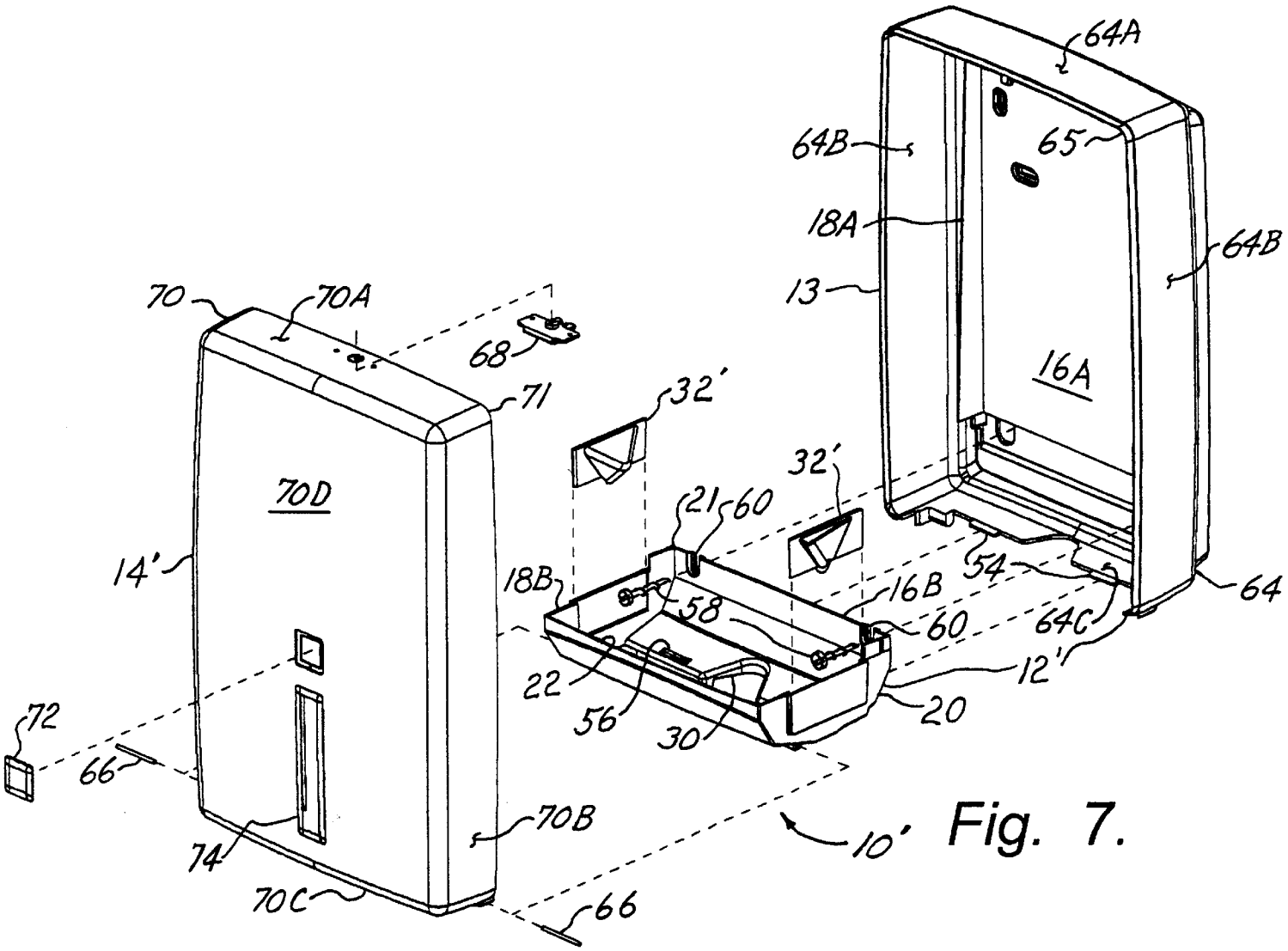
FIG. 7 is an exploded perspective view showing another alternative configuration of the dispenser of FIG. 1.
Figure 8:
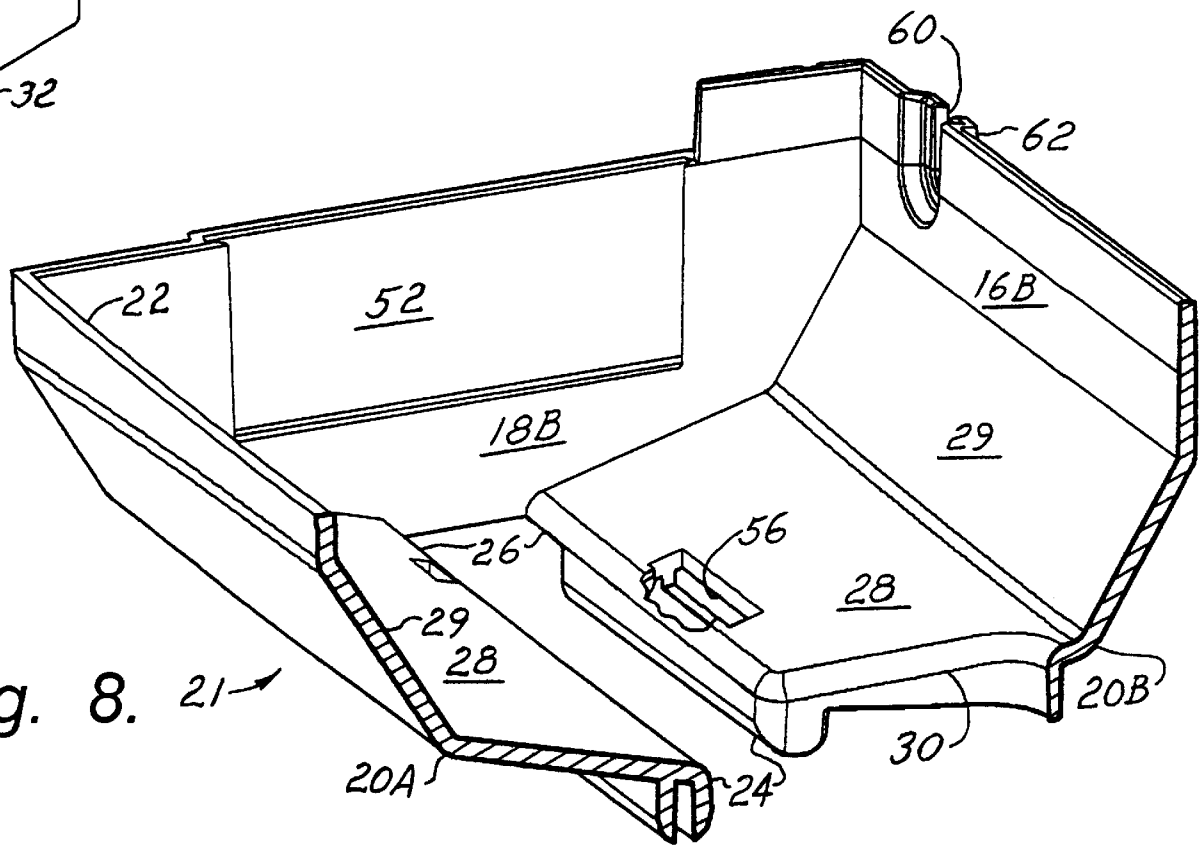
FIG. 8 is a sectional perspective view of a funnel portion of the dispenser of FIG. 7.
Figure 9:
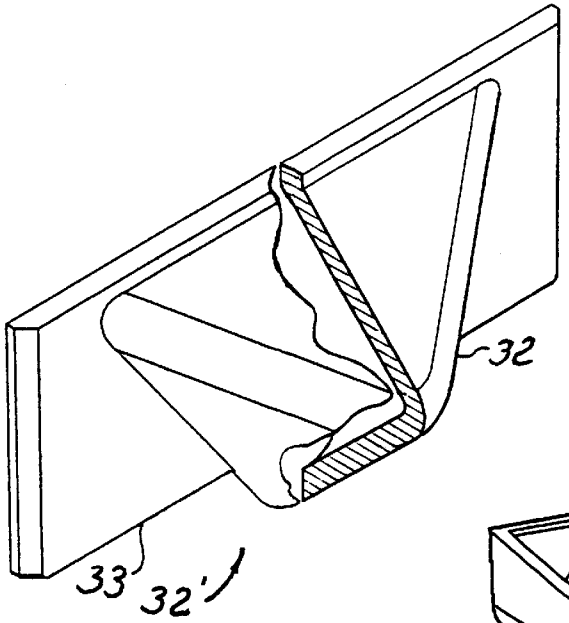
FIG. 9 is a detail perspective view of a shelf portion of the dispenser of FIG. 7.

With further reference to FIGS. 7–9, an alternative configuration of the dispenser, designated 10', incorporates removable shelf modules 32' having counterparts of the shelf members 32 integrally formed with a registration member 33, whereby the shelf members 32 can easily be exchanged for ones differently configured to thereby effect one or more of the above-described adjustments. The dispenser 10', being configured for production fabrication, has a counterpart of the housing, designated 12', separately molded as a rear member 13 and a funnel member 21, the back wall 16 and the side walls 18 being formed as separable upper and lower back wall portions 16A and 16B and side wall portions 18A and 18B, respectively. The funnel member 21 also includes a counterpart of the front wall 22. The dispenser 10' also has a counterpart of the door, designated 14' and described below.

The funnel member 21 is formed with a recess 52 in each of the lower side wall portions 18B for receiving the respective registration members 33, the recesses 52 and the registration members 33 being formed for vertical dovetail engagement with the registration members 32 being flush with the lower side wall portions 18B. The upper side wall portions 18A extend forwardly only partway, not extending over the recesses 52 for clearing the registration members 33 being moved into or out of the recesses 52. Thus the shelf members 32 are accessible for exchange thereof when the door 14' is open. It will be understood that alternatively, the upper wall portions can be made to extend over the recesses for locking the shelf modules 32' in place until the upper and lower side wall portions 18A and 18B are separated, such as by disconnecting the funnel member 21 from the rear member 13.

The funnel member 21 is connected to the rear member 13 by a pair of forwardly extending tabs 54 of the rear member 13 projecting into respective tab cavities 56 of the funnel member 21. The tabs 54 can be configured for snap engagement with the cavities 56 in a conventional manner. Once connected to the rear member 13 as described above, the funnel member 21 is rigidly secured thereto when the dispenser 10' is mounted onto a wall surface by a pair of wall fasteners 58 engaging respective fastener openings 60 of the funnel member 21, the fastener openings being in respective enlargements 62 that project through the rear member 13 behind the lower back wall portion 16.

The rear member 13 is formed with an outside wall 64 having a top portion 64A, side portions 64B, and a bottom portion 64C, the outside wall 64 extending forwardly to only approximately half of an overall depth of the dispenser 10', an inside lip 65 extending along the top portion 64A and the side portions 64B of the wall 64. The side portions 64B are spaced sufficiently apart for accommodating the recesses 52 of the funnel member 21.

The door 14' is formed for closely fitting the outside wall 64 of the rear member 13, being pivotally connected to the funnel member 21 proximate opposite ends of the feed slot 24 by respective hinge pins 66, and having a conventional locking latch 68 for servicing access to the interior of the housing 12'. Accordingly, the door 14' includes an outside wall 70 having a top portion 70A, side portions 70B, a bottom portion 70C, and a front portion 70D. An outside lip 71 extends about the top portion 70A and the side portions 70B for excluding water from the interior of the dispenser 10', the outside lip 71 closely overlapping the inside lip 65 of the rear member 13.

As further shown in FIG. 7, the door 14' has a button insert 72 that can be provided with a desired product identifier, and a window insert 74 for viewing and monitoring the size of the stack 23.

Although the present invention has been described in considerable detail with reference to certain preferred versions thereof, other versions are possible. For example, the shelf members 32 can be integrally formed with the side walls 18, such as by forming the housing 12, including the shelf members, as a single molded part. Formation of the shelf members would then be facilitated by enlarging end portions of the feed slot 24 proximate the side walls 18 for accommodating mold core elements. In the configuration of FIGS. 7–9, it is contemplated that a supply of shelf modules differently configured as to the taper angle θ, the side angel ϕ, the shelf width F, the shelf length L, the shelf lip radius R3, the shelf plan radius R4, and/or the shelf thickness T will be provided for facilitating adjustment of the shelf members 32 to accommodate different kinds and sizes of the sheets 25. Therefore, the spirit and scope of the appended claims should not necessarily be limited to the description of the preferred versions contained herein.

What is claimed is:

1. A dispenser apparatus for stacked single-fold towel sheets, the stacked sheets having a stack width and a stack depth, the apparatus comprising:

(a) a housing having a rear wall of width not less than the stack width, side walls of width not less than the stack depth, and a funnel portion including front and rear funnel walls extending between bottom portions of the side walls, the funnel walls being spaced apart, forming a feed slot; and (b) a pair of shelf members projecting downwardly and inwardly from respective ones of the side walls, each shelf member having a shelf width in a direction perpendicular to the rear wall, the shelf width being less than the stack depth, inward extremities of the shelf members being located above the feed slot and spaced apart by a distance of not greater than approximately 90 percent of the stack width for partially supporting the sheets, wherein each shelf member has an upwardly and inwardly facing panel surface and a perimeter contour, the perimeter contour tapering from the shelf width toward the inward extremity.

2. The dispenser apparatus of claim 1, wherein each shelf member has an edge profile along the perimeter contour, the edge profiled having a smooth curvature extending outwardly and downwardly from the panel surface.

3. The dispenser apparatus of claim 2, wherein the edge profile includes a shelf lip radius, the shelf lip radius being not less than approximately 0.1 inch.

4. The dispenser apparatus of claim 1, wherein the perimeter contour of each shelf member has a plan radius at the inward extremity, the plan radius being not less than approximately 0.3 inch.

5. The dispenser apparatus of claim 4, wherein the perimeter contour diverges from the plan radius at a taper angle of approximately 90 degrees.

6. The dispenser apparatus of claim 1, wherein the shelf width is not more than approximately half of the stack depth.

7. The dispenser apparatus of claim 6, wherein the funnel portion has a housing depth extending forwardly of the rear wall, the shelf width being approximately 45 percent of the housing depth.

8. The dispenser apparatus of claim 1, wherein the panel surface of each shelf member forms a side angle of approximately 45 degrees with the side wall.

9. The dispenser apparatus of claim 1, wherein the funnel portion has a funnel height, the location of the inner extremities of the shelf portions above the feed slot being within the funnel height.

10. The dispenser apparatus of claim 9, wherein the shelf members are adjustably connected to the respective side walls.

11. The dispenser apparatus of claim 9, wherein the feed slot has an enlargement formed by a notch in one of the funnel walls, and the inner extremities of the shelf members are located in a direction perpendicular to the rear wall laterally within the feed slot and not more than halfway toward the funnel wall having the notch from the other funnel wall.

12. The dispenser apparatus of claim 1, further comprising a shelf spacer selectively connected between one side wall and an associated shelf member for adjusting the shelf spacing.

13. The dispenser apparatus of claim 1, further comprising a pair of shelf modules, each shelf module including one of the shelf members and a registration member, the side walls of the housing further comprising respective engagement members for locatably receiving the registration members.

14. The dispenser apparatus of claim 13, wherein each engagement member is formed as a recess in a corresponding side wall of the housing, each registration member forming a flush insert in the side wall.

15. The dispenser apparatus of claim 14, wherein the side walls include substantially flush upper and lower side wall portions, the recesses being formed in upper extremities of the lower side wall portions, the registration members having vertical dovetail engagement with the recesses, upwardly extending edges of the upper side wall portions being located for allowing passage of the registration members downwardly into the recesses.

16. The dispenser apparatus of claim 14, wherein the side walls are formed as separable upper and lower side wall portions, the housing having a rear member including the upper side wall portions and a funnel member including the lower side wall portions and the funnel portion, the funnel member being insertable in the rear member and having a fastener opening for receiving a wall-mounting fastener whereby the rear member is fixedly located relative to the funnel member when the funnel member is inserted in the rear member and clamped to a wall by the wall-mounting fastener, the recesses being formed in the lower side wall portions, the registration members having vertical dovetail engagement with the recesses.

17. A dispenser apparatus for stacked single-fold towel sheets, the stacked sheets having a stack width and a stack depth, the apparatus comprising:

(a) a housing having a rear wall of width exceeding the stack width, side walls of width exceeding the stack depth, and a funnel portion including front and rear funnel walls extending between bottom portions of the side walls, the funnel walls being spaced apart, forming a feed slot, the funnel portion having a housing depth extending forwardly of the rear wall and having a funnel height; and (b) a pair of shelf members projecting downwardly and inwardly from respective ones of the side walls, each shelf member having a shelf width in a direction perpendicular to the rear wall, the shelf width being approximately 45 percent of the housing depth, inward extremities of the shelf members being spaced apart by a distance of not greater than approximately 90 percent of the stack width for partially supporting the sheets, the inward extremities being spaced above the feed slot within the funnel height; each shelf member having an upwardly and inwardly facing panel surface, the panel surface forming a side angle of approximately 45 degrees with the side wall; a perimeter contour of each shelf member having a plan radius of approximately 0.5 inch at the inward extremity, and diverging to the shelf width from the plan radius at a taper angle of approximately 90 degrees, the perimeter contour having an edge profile of smooth curvature including a shelf lip radius of approximately 0.15 inch extending outwardly and downwardly from the panel surface.

* * * * *